United States Patent [19]

Dyer et al.

[11] Patent Number: 4,903,082

[45] Date of Patent: Feb. 20, 1990

[54] LIQUID INK FUSING AND DRYING SYSTEM

[75] Inventors: Dexter A. Dyer, Williamson; Michael J. Langdon, Pittsford; Henry B. Peters, Jr., Webster; Thomas F. Szlucha, Fairport, all of N.Y.

[73] Assignee: Xerox Corporation, Stamford, Conn.

[21] Appl. No.: 192,076

[22] Filed: May 10, 1988

[51] Int. Cl.[4] ..... G03G 15/20

[52] U.S. Cl. ..... 355/290; 355/285; 355/295

[58] Field of Search ..... 355/256, 282, 285, 289, 355/293, 295, 312, 290; 219/216; 430/99, 124; 432/59, 60; 118/60

[56] References Cited

U.S. PATENT DOCUMENTS

| | | | |
|---|---|---|---|
| 4,059,394 | 11/1977 | Ariyama et al. | 355/285 X |
| 4,474,456 | 10/1984 | Kobayashi et al. | 355/285 |
| 4,520,048 | 5/1985 | Ranger | 118/60 X |
| 4,566,783 | 1/1986 | Schwierz et al. | 355/14 FU |
| 4,607,947 | 8/1986 | Ensing et al. | 355/15 |
| 4,627,813 | 12/1986 | Sasaki | 432/60 |
| 4,639,405 | 1/1987 | Franke | 219/216 X |
| 4,668,073 | 5/1987 | Hatabe et al. | 355/3 FU |
| 4,731,635 | 3/1988 | Szlucha et al. | 355/290 |
| 4,745,432 | 5/1988 | Langdon | 355/290 |

*Primary Examiner*—A. T. Grimley
*Assistant Examiner*—Edward Pipala
*Attorney, Agent, or Firm*—H. Fleischer; J. E. Beck; R. Zibelli

[57] ABSTRACT

An apparatus which dries and fuses a liquid image of liquid carrier and toner particles to a sheet. The sheet passes through a nip defined by a support member cooperating with a roller. The roller contacts the liquid image on the sheet. Heat is applied to the liquid image to fuse the toner particles to the sheet and vaporize at least a portion of the liquid carrier therefrom. The side of the sheet opposed from the side having the liquid image thereon is maintained at a lower pressure than atmospheric pressure to reduce the amount of heat required to vaporize the liquid carrier and remove the vaporized liquid carrier therefrom.

2 Claims, 2 Drawing Sheets

LIQUID INK FUSING AND DRYING SYSTEM

This invention relates generally to an electrophotographic printing machine, and more particularly concerns fusing a liquid image to a copy sheet and drying the sheet.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a liquid developer material into contact therewith. The liquid developer material comprises a liquid carrier having pigmented particles, i.e. toner particles, dispersed therein. The toner particles are deposited, in image configuration, on the photoconductive member. Thereafter, the developed image is transferred to the copy sheet. Invariably, some of the liquid carrier is transferred along with the toner particles to the copy sheet. After transfer, heat is applied to the copy sheet to permanently fuse the toner particles to the copy sheet and vaporize the residual liquid carrier adhering thereto. Presently, the fusing system requires a large amount of heat to fuse the pigmented particles and maintain the liquid carrier vapor levels at a safe operating condition, i.e. less than 25% of the lower explosion limit.

Numerous techniques have been developed for heating the developed image on the copy sheet to permanently fuse the toner particles thereto. Among these are oven fusing, hot air fusing, flash fusing and roll fusing. It has been found that roll fusing requires significantly lower energy requirements than radiant or oven fusing. Moreover, there is a reduced production of water vapor due to reducing the bulk heating of the copy sheet during the fusing of the toner particles thereto. Previously, fusing of the toner particles to the copy sheet required high fuser temperatures. Moreover, not only must the toner particles be fused to the copy sheet, but the residual liquid carrier remaining on the copy sheet must be removed therefrom to dry the copy sheet. This requires that the residual liquid carrier be vaporized. However, in the office environment vaporized liquid carrier, in high concentrations, can pose a health hazard which must be minimized. In order to insure that the electrophotographic printing machine may be employed in an office environment, the vaporized liquid carrier cannot be vented to the atmosphere but must be recovered prior to the discharge of the liquid carrier saturated air to the atmosphere. Hereinbefore, various techniques have been devised for fusing the liquid image and drying the copy sheet. The following disclosures appear to be relevant:

US-A-4,566,783;
Patentee: Schwierz et al.
Issued: Jan. 28, 1986.
US-A-4,607,947;
Patentee: Ensing et al.
Issued: Aug. 26, 1986.
US-A-4,627,813;
Patentee: Sasaki
Issued: Dec. 9, 1986.
US-A-4,668,073;
Patentee: Hatabe et al.
Issued: May 26, 1987.

The relevant portions of the foregoing disclosures may be briefly summarized as follows:

US-A-4,566,783 discloses a thermal fixing device having a curved plate and a pressure roller. Heating elements are embedded in the curved plate. The sheet passes between the pressure roller and curved plate.

US-A4,607,947 describes a heated roller and a pressure roller defining a nip through which a copy sheet passes. The heated roller contacts a photoconductive belt having a dry toner image thereon. The toner image is transferred to the heated roller and softened. The softened toner image is then transferred to the copy sheet. Cleaning rollers contact the heated roller and pressure roller to remove residue therefrom.

US-A-4,627,813 discloses a thermal fixing apparatus for use in a copying machine. The fixing apparatus has a heated fixing roll and a back-up roll with a heated plate positioned adjacent and prior to the nip defined by the rollers.

US-A-4,668,073 describes a photographic fixing apparatus in which photosensitive material is fed into a nip defined by upper and lower inclined guide plates. The guide plates are ventilated to permit the passage of air from a blower located below the lower plate.

In accordance with one aspect of the present invention, there is provided an apparatus for fusing a liquid image of liquid carrier and toner particles to a sheet. The apparatus includes a roller arranged to contact the liquid image on the sheet. A support member cooperates with the roller to define a nip through which the sheet having the liquid image thereon passes. Means are provided for heating the liquid image to fuse the toner particles to the sheet and vaporize at least a portion of the liquid carrier therefrom. Means maintain the side of the sheet opposed from the side having the liquid image thereon at a lower pressure than atmospheric pressure to reduce the amount of heat required to vaporize the liquid carrier and remove the vaporized liquid carrier therefrom.

Pursuant to another aspect of the features of the present invention, there is provided an electrophotographic printing machine including a photoconductive member. Means are provided for recording an electrostatic latent image on the photoconductive member. Means develop the latent image recorded on the photoconductive member with a liquid developer material comprising at least a liquid carrier having pigmented particles dispersed therein. Means transfer the developed image from the photoconductive member to a sheet. A roller is arranged to contact the developed image on the sheet. A support member cooperates with the roller to define a nip through which the sheet having the developed image thereon passes. Means heat the developed image to fuse the toner particles to the sheet and vaporize at least a portion of the liquid carrier therefrom. Means maintain the side of the sheet opposed from the side having the developed image thereon at a lower pressure than atmospheric pressure to reduce the heat required to vaporize the liquid carrier and remove the vaporized liquid carrier therefrom.

Still another aspect of the present invention describes an apparatus of the type in which a liquid developed image having liquid carrier and toner particles is fused to at least one side of a sheet. The apparatus has an air previous support member arranged to contact the other side of the sheet. A roller cooperates with the support member to define a nip through which the sheet passes. Means heat the developed image to fuse the toner particles to the sheet and vaporize at least a portion of the liquid carrier therefrom. Means, connected to the support member, maintain the other side of the sheet at a lower pressure than atmospheric pressure to reduce the heat required to vaporize the liquid carrier and remove the vaporized liquid carrier from the sheet.

Other aspects of the present invention will become apparent as the following description proceeds and upon reference to the drawings, in which.

While the present invention will hereinafter be described in conjunction with various embodiments thereof, it will be understood that it is not intended to limit the invention to these embodiments. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
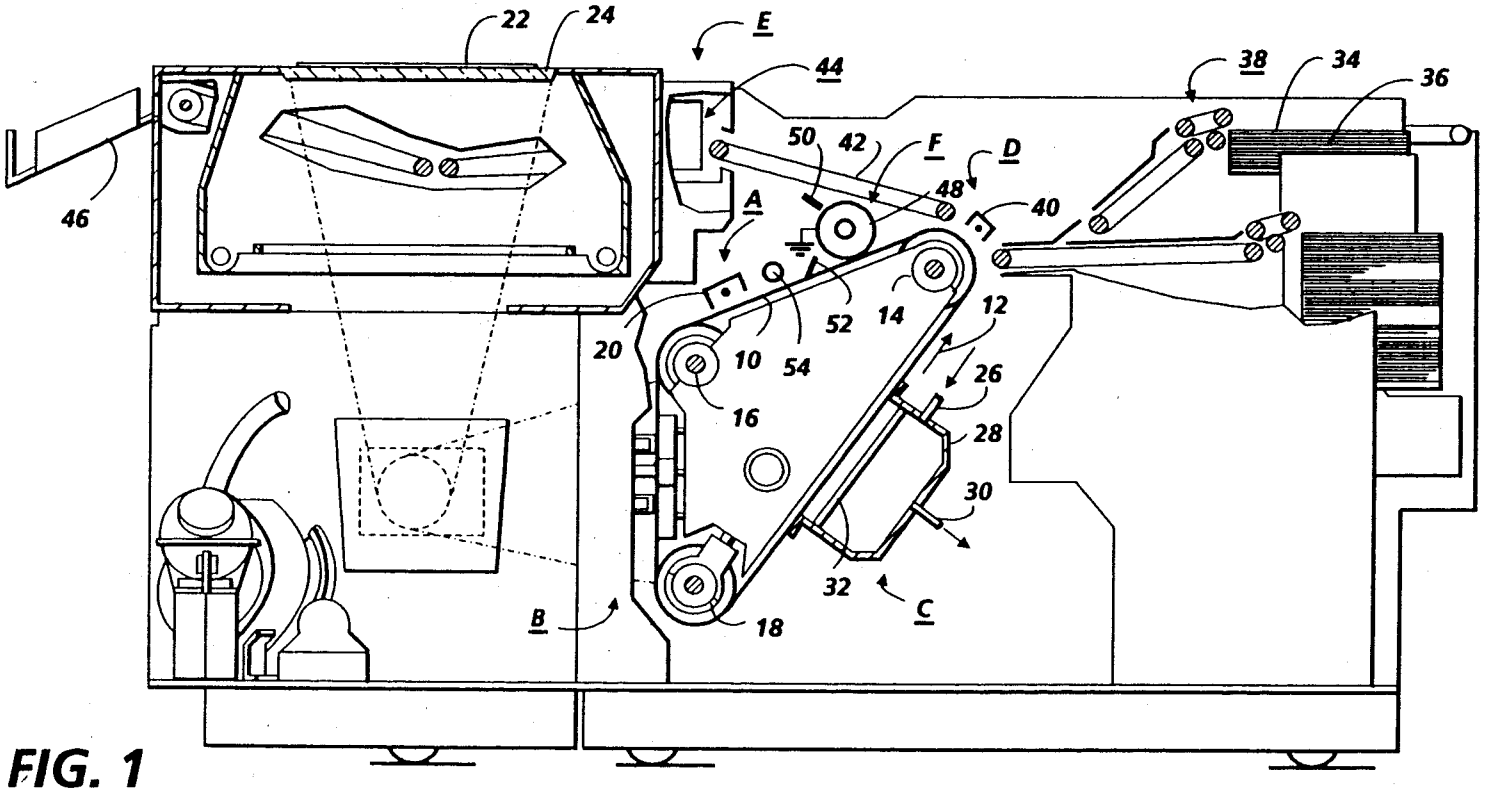
FIG. 1 is a schematic elevational view showing an illustrative electrophotographic printing machine incorporating the features of the present invention therein.

Turning now to FIG. 1, the electrophotographic printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Belt 10 moves in the direction of arrow 12 to advance successive portions of the photoconductive surface through the various processing stations disposed about the path of movement thereof. Belt 10 is supported by three rollers 14, 16, and 18 located with parallel axes at approximately the apexes of a triangle. Roller 14 is rotatably driven by a suitable motor associated with a drive (not shown) to move belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential.

Next, the charged portion of the photoconductive surface is advanced through exposure station B. At exposure station B, an original document 22 is positioned face down upon a transparent platen 24. Lamps flash light rays onto original document 22. The light rays reflected from original document 22 are transmitted through a lens forming a light image thereof. The lens focuses the light image onto the charged portion of the photoconductive surface to selectively dissipate the charge thereon. This records an electrostatic latent image on the photoconductive surface corresponding to the informational areas contained within the original document. Thereafter, belt 10 advances the electrostatic latent image recorded on the photoconductive surface to development station C.

At development station C, a developing liquid comprising an insulating carrier liquid and toner particles, is circulated from any suitable source (not shown) through pipe 26 into development tray 28 from which it is withdrawn through pipe 30 for recirculation. Development electrode 32, which may be appropriately electrically biased, assists in developing the electrostatic latent image with the toner particles, i.e. the pigmented particles dispersed in the liquid carrier, as it passes in contact with the developing liquid. The charged toner articles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, the amount of liquid carrier on the photoconductive surface is too great. A roller (not shown) whose surface moves in a direction opposite to the direction of movement of the photoconductive surface, is spaced from the photoconductive surface and adapted to shear excessive liquid from the developed image without disturbing the image.

After development, belt 10 advances the developed image to transfer station D. At transfer station D, a sheet of support material 34, i.e. a copy sheet, is advanced from stack 36 by a sheet feeder, indicated generally by the reference numeral 38. The sheet of support material advances in synchronism with the movement of the developed image on belt 10 so as to arrive simultaneously therewith at transfer station D. Transfer station D includes a corona generating device 40 which sprays ions onto the backside of the copy sheet. This attracts the developed image from the photoconductive surface to the copy sheet. After transfer, the copy sheet continues to move onto conveyor 42 which advances the sheet to fusing station E.

Fusing station E includes a fusing system indicated generally by the reference numeral 44. The fuser assembly vaporizes the liquid carrier from the copy sheet and permanently fuses the toner particles, in image configuration, thereto. The detailed structure of the various embodiments of fusing system 44 will be described hereinafter with reference to FIGS. 2 and 3. After fusing, the copy sheet is advanced to catch tray 46 for subsequent removal from the printing machine by the operator.

After the copy sheet is separated from the photoconductive surface of belt 10, some residual liquid developer material remains adhering thereto. This residual developer material is removed from the photoconductive surface at cleaning station F. Cleaning station F includes a cleaning roller 48, formed of any appropriate synthetic resin driven in a direction opposite to the direction of movement of the photoconductive surface to scrub the photoconductive surface clean. To assist in this action, developing liquid may be fed through pipe 50 onto the surface of cleaning roller 48. A wiper blade 52 completes the cleaning of the photoconductive surface. Any residual charge left on the photoconductive surface is extinquished by flooding the photoconductive surface with light from lamp 54.

Preferably, the developer material includes a liquid insulating carrier having pigmented particles, i.e. toner particles, dispersed therein. A suitable insulating liquid carrier may be made from an aliphatic hydrocarbon, such as an Isopar, which is a trademark of the Exxon Corporation, having a low boiling point. The toner particles include a pigment, such as carbon black, associated with the polymer. A suitable liquid developer material is described in U.S. Pat. No. 4,582,774, issued to Landa in 1986, the relevant portions thereof being incorporated into the present application.

It is believed that the foregoing description is sufficient for purposes of the present application to illustrate the general operation of an electrophotographic printing machine incorporating the features of the present invention therein.

Figure 2:
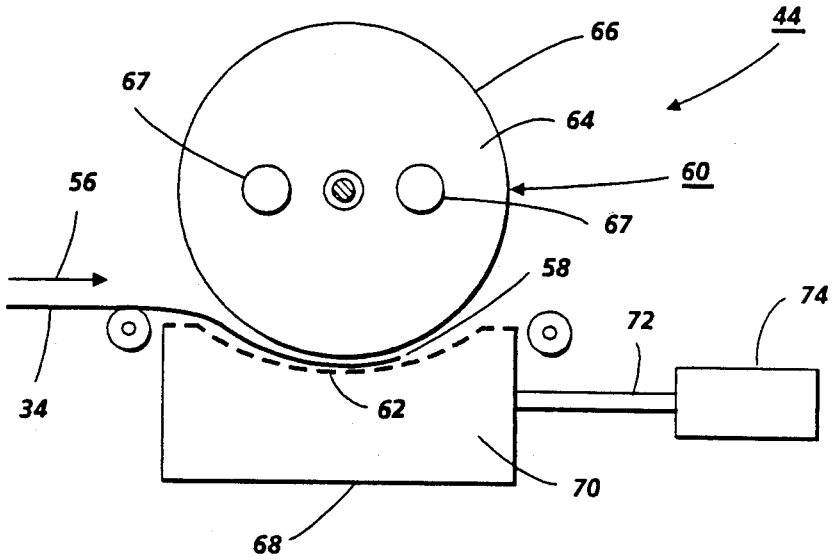
FIG. 2 is a schematic elevational view depicting one embodiment of a fusing system used in the FIG. 1 printing machine.

Referring now to FIG. 2, there is shown one embodiment of fuser system 44 in greater detail. As depicted thereat, copy sheet 34 advances, in the direction of arrow 56, into nip 58 defined by a fuser roller indicated generally by the reference numeral 60 and an arcuate plate 62. Roller 60 is resiliently urged into engagement with plate 62 to define nip 58. The surface of copy sheet 34 having the liquid image thereon contacts fuser roller 60. Preferably, fuser roller 60 includes a rigid internal core 64 which may be steel over which is a sleeve-like covering 66, such as Silicone rubber. To heat fuser roller 60, lamps 67 are disposed within fuser roller core 64. The core has a suitable openings for receipt of the lamps. Heat energy from the lamps permeate through the metal core and the outer sleeve to the surface of the fuser roller. This enables the fuser roller to heat the copy sheet to the requisite temperature required to fuse the pigmented particles to the copy sheet and vaporize the liquid carrier. Preferably, fuser roller 60 and plate 62 apply from between 50 to 150 pounds per square inch of pressure on the copy sheet with the copy sheet being heated from about 210° F. to about 280° F. (100° to about 140° C.). At these temperatures and pressures, the pigmented particles are fused to the copy sheet and the liquid carrier vaporized. Plate 62 is air pervious, e.g. it has a plurality of holes or slots therein. Plate 62 is the upper surface of a housing 68 defining chamber 70. A pipe 72 connects chamber 70 to an exhaust pump 74. Pump 74 maintains chamber 70 at negative pressure, i.e. a pressure less than atmospheric pressure. This negative or lower pressure causes vaporization of the liquid carrier at lower temperatures reducing the the required heat from the fuser roller. As copy sheet 34 passes into nip 58, the liquid carrier thereon vaporizes. The vaporized liquid carrier is drawn though sheet 34 (which is made from a porous material such as paper) through the openings in plate 62 and into chamber 70. The vaporized liquid carrier flows to a condenser (not shown) where the it is liquefied and collected for subsequent re-use.

Figure 3:
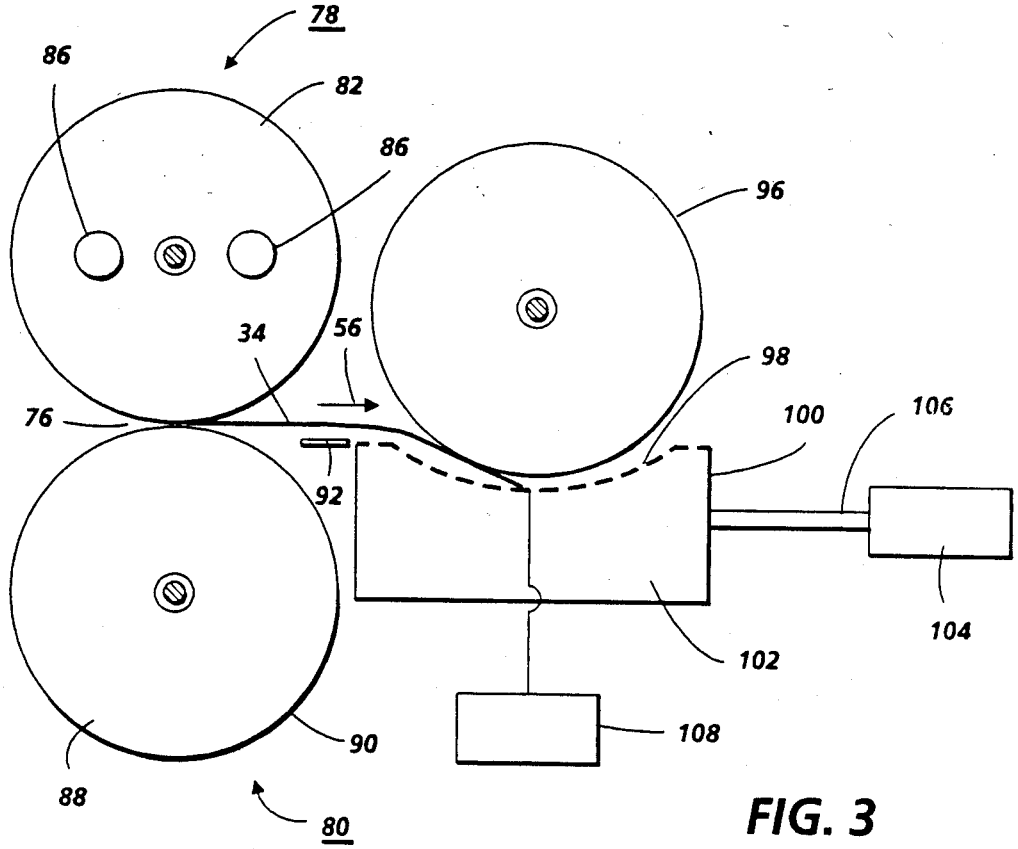
FIG. 3 is a schematic elevational view showing another embodiment of the fusing system used in the FIG. 1 printing machine.

Turning now to FIG. 3, there is shown another embodiment of fusing system 44. As shown in FIG. 3, copy sheet 34 advances in the direction of arrow 56 into nip 76 defined by a fuser roller, indicated generally by the reference numeral 78, and a back-up pressure roller, indicated generally by the reference numeral 80. Rollers 78 and 80 are resiliently urged into engagement with one another to define nip 76. Preferably, fuser roller 78 includes a rigid internal core 82 which may be steel over which is a sleeve-like covering 84, such as Silicone rubber. To heat fuser roller 82, lamps 86 are disposed within fuser roller core 82. The core has suitable openings for receipt of the lamps. Heat energy from the lamps permeate through the metal core and the outer sleeve to the surface of the fuser roller. This enables the fuser roller to heat the copy sheet to the requisite temperature required to fuse the pigmented particles to the copy sheet. Preferably, fuser roller 60 and pressure roller 62 apply from between 50 to 150 pounds per square inch of pressure on the copy sheet with the copy sheet being heated from about 210° F. to about 280° F. (100° C. to about 140° C.). Preferably, pressure roller 80 includes a rigid internal core 88 which may be steel, over which is mounted a sleeve-like cover 90 of flexible material having non-stick properties, such as Teflon. After copy sheet 34 exits nip 76, it is guided by plate 92 into nip 94 defined by roller 96 and arcuate plate 98. Arcuate plate 98 forms the upper surface of housing 100 which defines chamber 102. Plate 98 is air pervious and has a plurality of apertures, i.e. holes or slots, therein. Exhaust pump 104 is connected to chamber 102 via pipe 106. The pressure within chamber 102 is lowered so that it is beneath atmospheric pressure. This lower pressure causes vaporization of the liquid carrier at lower temperatures. Plate 98 may be made fromm a heat conductive metal, such as aluminum. Heating bars are embedded in the plate and connected to power supply 108. A control circuit employing a temperature sensor regulates the output power from power supply 108. In thi way, the energy output from the heateing bars is controlled to maintain plate 98 at a selected temperature. Plate 98 heats the side of the copy sheet opposed to the side thereof having the image thereon. Roller 96 is porous, preferably being made from an open celled polyurethane material. Roller 96 is resiliently urged into contact with plate 98. In this manner, sheet 34 has the side with the image thereon in contact with roller 96 with the opposed side being in contact with heated plate 98. As copy sheet 34 passes into nip 76, the residual liquid carrier thereon is heated and vaporizes. The vaporized liquid carrier is drawn though sheet 34 (which is made from a porous material such as paper) through the openings in plate 98 and into chamber 102. The vaporized liquid carrier flows to a condenser (not shown) where the vaporized liquid carrier is liquefied and collected for subsequent re-use.

In capitulation, it is clear that the fusing system of the present invention includes a roller cooperating with an arcuate, air pervious plate to define a nip through which the copy sheet passes. In one embodiment, the roller is heated and fuses the toner to the sheet. The side of the copy sheet adjacent the plate is maintained at a pressure less than atmospheric pressure to reduce the required heat to vaporize the liquid carrier and remove the vaporized liquid carrier. In another embodiment, the copy sheet initially passes through a nip defined by a heated roller and a back-up roller to fuse the image thereon. The sheet then passes between a heated, air pervious, arcuate plate and a porous roller. A pressure less than atmospheric pressure is maintained on the side of the copy sheet opposed to that having the image thereon. The lower pressure reduces the amount of heat required to vaporize the liquid carrier and removes the vaporized liquid carrier therefrom.

It is, therefore, evidence that there has been provided in accordance with the present invention, a fusing system that fully satisfies the aims and advantages heretofore mentioned. While this invention has been described in conjunction with various embodiments, it is evident that many alternatives, modifications and variations will be apparent to those skilled in the art. Accordingly, it is intended to embrace all such alternatives, modifications and variations that fall within the spirit and broad scope of the appended claims.

We claim:

1. An apparatus for fusing a liquid image of liquid carrier and toner particles to a sheet, including:

a substantially porous first roller arranged to contact the liquid image on the sheet;

a housing defining a chamber and having an arcuate, air pervious, heated plate positioned adjacent said first roller defining a nip through which the sheet having the liquid image thereon passes;

a heated fuse roller;

a pressure roller cooperating with said fuser roller to define a nip through which the sheet passes with the liquid image thereon contacting said fuser roller to fuse the toner particles to the sheet and vaporize at least a portion of the liquid carrier therefrom with the sheet passing through the nip defined by said fuser roller and said pressure roller before passing through the nip defined by said plate and said first roller; and means, coupled to said plate, for maintaining the side of the sheet adjacent said plate at a lower pressure than atmospheric pressure to reduce the heat required to vaporize the liquid carrier and remove the vaporized liquid carrier therefrom.

2. An apparatus according to claim 1, wherein said maintaining means includes an exhaust pump connected to the chamber of said housing and being adapted to maintain the chamber at the lower pressure.

* * * * *